US010119784B1

(12) United States Patent
Ding et al.

(10) Patent No.: US 10,119,784 B1
(45) Date of Patent: Nov. 6, 2018

(54) SINGLE AXIS LOCK AND PIVOT FOR A SELECTIVELY CONFIGURABLE FIREARM SIGHT

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 15/871,711

(22) Filed: Jan. 15, 2018

(51) Int. Cl.
*F41G 1/033* (2006.01)
*F41G 1/16* (2006.01)
*F41G 11/00* (2006.01)

(52) U.S. Cl.
CPC ..... *F41G 1/033* (2013.01); *F41G 1/16* (2013.01); *F41G 11/003* (2013.01)

(58) Field of Classification Search
CPC ..... F41G 1/02; F41G 1/033
USPC ..... 42/128, 136
See application file for complete search history.

(56) References Cited

U.S. PATENT DOCUMENTS

D494,471 S 8/2004 Chou
D505,328 S 5/2005 Chou
D510,120 S 9/2005 Ding
D511,365 S 11/2005 Ding
D513,056 S 12/2005 Ding
D513,298 S 12/2005 Ding
D513,299 S 12/2005 Ding
D513,633 S 1/2006 Ding
D516,157 S 2/2006 Ding
D594,084 S 6/2009 Mayberry et al.
D638,089 S 5/2011 Ding
D639,376 S 6/2011 Ding
D641,450 S 7/2011 Ding
D648,413 S 11/2011 Mayberry et al.
D649,993 S 12/2011 Ding
(Continued)

FOREIGN PATENT DOCUMENTS

EP 2520894 A1 7/2012
WO 2013082274 A1 6/2013

OTHER PUBLICATIONS

Leapers, Inc. UTG 400 Luman Everyday Defense LED L-light downloaded from https://www.leapers.com/index.php?act=prod_detail&midx=988&allids=988&itemno=LT-EL223HL-A on Nov. 27, 2017.

(Continued)

*Primary Examiner* — Reginald S Tillman, Jr.
(74) *Attorney, Agent, or Firm* — Warner Norcross + Judd, LLP

(57) ABSTRACT

A configurable sight for a firearm is provided including a plunger that is coaxially disposed within a bore of a sight element and a bias element that biases the sight element to an upright position, where the plunger selectively interlocks in the bore in different orientations to secure the sight in different positions, such as an upright position or a down position. The plunger can be slidably locked and unlocked relative to the sight element on a longitudinal axis, and the sight element can be rotated about the same axis. The sight element bore can be defined by a sleeve fixedly mounted in the sight element, and that sleeve can include a slotted crown that selectively engages the plunger depending on the position of the sight element to lock the sight element in position. A related method is provided.

20 Claims, 7 Drawing Sheets

(56) References Cited

U.S. PATENT DOCUMENTS

| | | | |
|---|---|---|---|
| D654,552 | S | 2/2012 | Wu et al. |
| D659,221 | S | 5/2012 | Wu et al. |
| D672,839 | S | 12/2012 | Ding |
| 8,397,421 | B2 | 3/2013 | Ding et al. |
| 8,429,843 | B2 | 4/2013 | Yan |
| 8,437,079 | B2 | 5/2013 | Wu |
| D692,516 | S | 10/2013 | Yan et al. |
| D705,890 | S | 5/2014 | Fitzpatrick et al. |
| 8,752,325 | B2 | 6/2014 | Ding et al. |
| D711,492 | S | 8/2014 | Yan et al. |
| 8,806,792 | B2 | 8/2014 | Yan et al. |
| D726,278 | S | 4/2015 | Ding et al. |
| D727,455 | S | 4/2015 | Ding et al. |
| D728,728 | S | 5/2015 | Barfoot et al. |
| D730,474 | S | 5/2015 | Ding et al. |
| 9,169,958 | B2 | 10/2015 | Yan |
| D751,663 | S | 3/2016 | Ding et al. |
| D755,342 | S | 5/2016 | Ding et al. |
| D758,521 | S | 6/2016 | Ding et al. |
| D758,522 | S | 6/2016 | Ding et al. |
| D771,218 | S | 11/2016 | Ding et al. |
| D773,005 | S | 11/2016 | Ding et al. |
| 2006/0075674 | A1 | 4/2006 | Ding |
| 2007/0277422 | A1 | 12/2007 | Ding |
| 2012/0281278 | A1 | 11/2012 | Wu |
| 2016/0341502 | A1* | 11/2016 | Langevin ..... F41G 1/033 |

OTHER PUBLICATIONS

Leapers, Inc. UTG New Gen 400 Lumen Compact Grip Light with QD Mount downloaded from https://www.leapers.com/index.php?act=prod_detail&midx=988&allids=988&itemno=MNT-EL223GPQ-A on Nov. 27, 2017.

Leapers, Inc. UTG New Gen 400 Lumen Grip Light with QD Mounting Base downloaded from https://www.leapers.com/index.php?act=prod_detail&midx=988&allids=988&itemno=MNT-EL228GPQ-A on Nov. 27, 2017.

Leapers, Inc. UTG Flashlights and Lasers downloaded from https://www.leapers.com/index.php?act=listproduct&midx=988&allids=988&svroot=MOUNTING%20SYSTEMS on Nov. 27, 2017.

Leapers, Inc. UTG Mounting Systems downloaded from https://www.leapers.com/index.php?act=listproduct&midx=923&allids=918_919_923&svroot=MOUNTING%20SYSTEMS on Nov. 27, 2017.

Leapers, Inc. UTG 4.1" Lowpro Combat Quality QD Lever Mount Metal Foregrip downloaded from https://www.leapers.com/index.php?act=prod_detail&itemno=MNT-GRP001SQ&midx=1002&allids=1001_1002 on Nov. 27, 2017.

Leapers, Inc. UTG Model 4 Low Profile Flip-up Front Sight MNT-755 dowloaded from https://www.tacticalwholesalers.com/Leapers-Inc-Model-4-Low-Profile-Flip-up-Front-Sight-MNT-755_p_143421.html?gclid=EAIaIQobChMIIYywtYT21wIVB57A-Ch1IDwmuEAYYAyABEgKbX_D_BwE on Dec. 6, 2017.

Magpul, MBUS Front & Rear Sight Set downloaded from http://www.tomstactical.com/Magpul-MBUS-Gen-II-Front-Rear-Sight-Set-Black_p_74.html on Jan. 5, 2018.

LWRC International, LWRCI Skirmish Sight Set downloaded from https://www.lwrci.com/p-451-day-9-lwrci-skirmish-sight-set.aspx on Jan. 5, 2018.

Diamondhead, Polymer Diamond Integrated Sighting System (with NiteBrite) downloaded from https://www.diamondhead-usa.com/products/polymer-diamond-integrated-sighting-system-with-nitebrite on Jan. 5, 2018.

Precision Reflex Inc., Flip up Front and Rear Sight Package downloaded from https://www.lapolicegear.com/preflex-flip-up-sight-combo.html on Jan. 5, 2018.

Magpul, MBUS Pro Offset Sight—Front downloaded from https://www.magpul.com/products/mbus-pro-offset-sight-front on Jan. 5, 2018.

Troy Industries, Offset Sight Set, M4 Front and Dioptic Rear—FDE downloaded from https://troyind.com/products/offset-sight-set-m4-front-and-dioptic-rear-fde on Jan. 5, 2018.

HQ Issue, HQ Issue 45° Offset Sight Set downloaded from https://www.sportsmansguide.com/product/index/hq-issue-45deg-offset-sight-set?a=1781389 on Jan. 5, 2018.

Dagger Defense, Dagger Defense flip up BUIS 45 degree picatinny rail mounted backup iron sights downloaded from https://daggerdefense.com/?product=dagger-defense-flip-buis-45-degree-picatinny-rail-mounted-backup-iron-sights on Jan. 5, 2018.

* cited by examiner

SINGLE AXIS LOCK AND PIVOT FOR A SELECTIVELY CONFIGURABLE FIREARM SIGHT

BACKGROUND OF THE INVENTION

The present invention relates to firearms, and more particularly to a firearm sight configurable in deployed and stowed positions.

Firearms can come in various shapes and sizes, and can be configured in various ways for different purposes. Many firearms are outfitted with a sighting system to assist a user in aligning the barrel of the firearm with a target so that a projectile fired from the firearm has a high probability of impacting the target in a desired location. Sometimes, a firearm is set up with fixed position iron sights, with a rear sight at the rear of the firearm and a front sight on the barrel of the firearm near its muzzle. This system is configured so that the user can align the front and rear sights with one another and a target to aim the firearm. In other cases, the firearm can be outfitted with an optical sight to be used with the iron sight system, and sometimes co-witnessed with the iron sights, so that a user can see the iron sights through the optical sight. The optical sight can provide magnification to assist a user in aligning the firearm with a target at significant distances. The iron sights can be used at closer ranges.

Some iron sights can be foldable from an upright position, in which they can be aligned with a target during aiming, to a down position, in which they are stowed, so they do not obstruct the optical sight. Popular and high quality foldable sights are the UTG® MNT-755 and MNT-955 Flip up sights available from Leapers, Inc. of Livonia, Mich. These sights are configurable in up or down positions. Each includes a pivot axle about which part of the sight pivots up or down. Each also includes a separate lock that is distal from the pivot axle. This lock can require additional area on the sights to enable actuation of the lock distal from the pivot axle. With the separate pivot axle and lock, additional machining is also required to ensure that these two components fit within the sight adequately, and so that the lock mechanism is manually reachable.

In addition, while such sights are suitable for most applications, each can in some cases require extra dexterity to both hinge, flip and lock or unlock the sight to or from the up or down positions. Further, because the lock is distal from the pivot axle, when the lock releases, the sight will move in such a manner that the user's digit can lose contact with the lock, unless the user moves their digit while engaging the lock as the lock moves to an upright position. When the user is wearing gloves or the sight is wet or slippery due to the environment, this also can impair adequate, sustained pressure on the lock by the user as the sight moves.

Accordingly, there remains room for improvement in the field of flip up sights for firearms.

SUMMARY OF THE INVENTION

A configurable sight for a firearm is provided including a plunger that is coaxial with a bore of a sight element, and a bias element that biases the sight element to an upright position, where the plunger selectively engages in the bore in different orientations to secure the sight in different positions, such as an upright position or a down position. The plunger can be slidably locked and unlocked relative to the sight element on a longitudinal axis, and the sight element can be rotated about the same axis.

In one embodiment, the sight includes a base with a mounting portion. The mounting portion can mount to the firearm, for example to a rail associated with the firearm.

In another embodiment, the sight includes a sight element pivotally or movably mounted to a base. The sight element can be selectively configured in one of two primary positions, that is, an upright position and a down position. In the upright position, the sight element can expose a sight window and/or sight unit that the user can align with a target and/or another sight on the firearm. In the down position, the sight element can be stored in a relatively low profile configuration so as to prevent it from snagging or catching on clothing and other objects.

In still another embodiment, the bore of the sight element can be defined by a sleeve fixedly mounted in the sight element. The sleeve can include a slotted crown that selectively engages the plunger depending on the position of the sight element, to thereby lock the sight element in a particular position, such as the upright position or the down position.

In yet another embodiment, the sleeve can be configured to rotate around the shaft of the plunger when the plunger is in a free mode. This can change the orientation of the bore and/or the crown relative to the plunger. In effect, the plunger can operate as an axle about which the sight element rotates.

In even another embodiment, the plunger can include a polygonal shaped head with a one or more head locking surfaces that engage a surface of the sleeve or the bore to selectively lock the sight element in an upright position or in a down position. In some cases, the polygonal head can be rectangular, and can interfit within a similarly shaped recess defined by a flange of the base. In this construction, as the head engages the bore, the head can be non-rotatable relative to the base, even as the sight element rotates about the longitudinal axis.

In a further embodiment, the sight can include a bias element engaged with the sight element and the base to automatically urge the sight element to the upright position, generally deploying the sight element from the down position to the upright position. The bias element optionally can be a coil spring extending around a shaft of the plunger and/or an optional sleeve. The bias element can include a first spring portion that engages the base and a second spring portion that engages the sight element. The coil spring can be wound on the plunger or sleeve to store a spring force that urges the sight element to the upright position.

In still a further embodiment, the plunger can include a button on an opposing end of the plunger relative to the head. The button can be depressed to alter the plunger from a locking mode to a free mode. Another bias element can urge the button to an un-depressed mode, which in turn urges the head of the plunger to interlock with the sleeve or sight element bore, and thereby prevent rotation of the sight element from the upright position to the down position and vice versa.

In even a further embodiment, the plunger head can include different portions, such as a distal portion and a proximal portion. The distal portion can be configured to interfit in a plunger hole defined by a flange of the base and prevent the plunger from rotating relative to the base. The proximal portion can be tapered and configured to move into and out from a slot of the sleeve or the sight element in general, such that the plunger and sleeve can freely rotate relative to one another when the plunger is in the free mode.

In yet a further embodiment, the proximal portion can include one or more facets that slide relative to similarly configured facets of the sleeve or bore. When the facets of the proximal portion engage the facets of the sleeve or bore, the plunger cannot rotate, thus locking the sight element in an upright or down position.

In another embodiment, the various facets or locking surfaces of the head and the sleeve or bore can be acutely angled relative to the longitudinal axis.

In still another embodiment, a method is provided. The method can include providing a base including a mounting portion defining a plunger hole; sliding a plunger along a longitudinal axis in a first direction in a bore defined by a sight element in a down position so as to configure the plunger in a free mode in which the head disengages the bore so that the sight element is free to rotate about the longitudinal axis from the down position to an upright position; biasing the sight element from the down position to the upright position; releasing the plunger when the sight element attains the upright position so that the plunger slides along the longitudinal axis in a second direction, so the head engages the bore so as to configure the plunger in a locked upright mode so the sight element is locked in the upright position.

The current embodiments of the firearm sight and related method of use provide the benefits above that previously have been unachievable. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
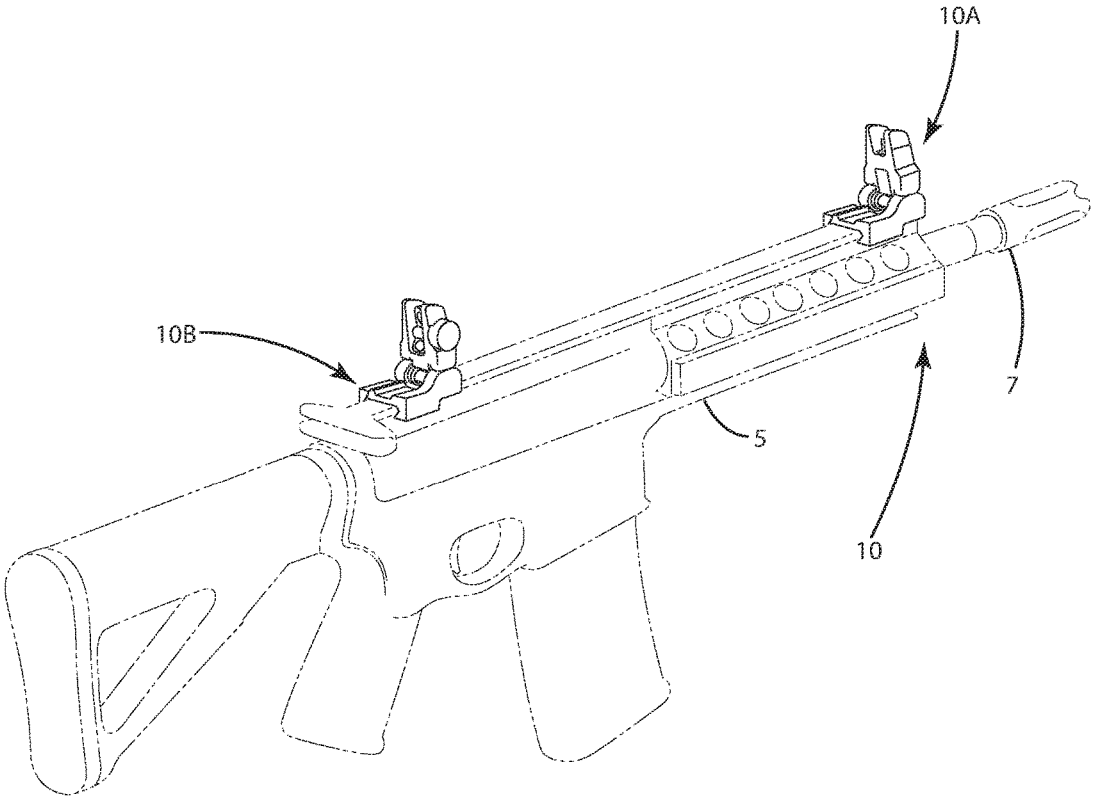
FIG. 1 is a rear perspective view of a firearm with selectively configurable sights of a current embodiment in an upright position.

A selectively configurable sight for a firearm of the current embodiment is illustrated in FIGS. 1-7 and generally designated 10. The selectively configurable sight 10 can be utilized for front or rear sights, optionally including windage and/or elevation adjustment mechanisms. As illustrated in FIG. 1, the sight 10 can be in the form of a front sight 10A and/or a rear sight 10B, mounted along a rail of the modern sporting rifle. The present sight 10 can be utilized with any type of firearm or weapon. The sight described herein will be a front sight, but again, the current embodiments can be utilized with a rear sight. Further the sight can be used, with firearms, such as shotguns, handguns, artillery weapons, as well as archery devices, such as compound bows and crossbows or other projectile shooting devices.

Figure 2:
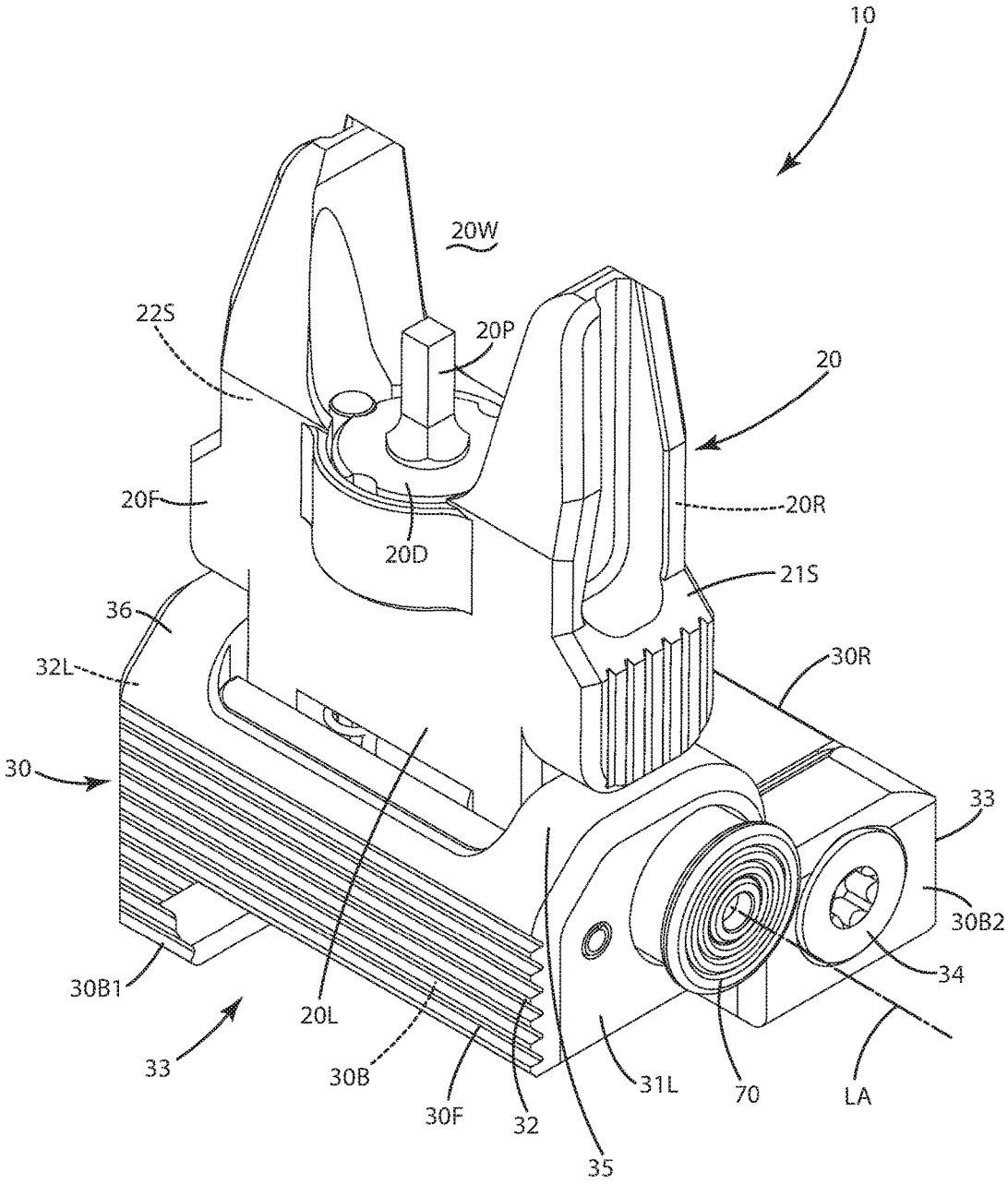
FIG. 2 is a front perspective view of a front firearm sight of a current embodiment in an upright position.

With reference to FIG. 2, the sight 10, can include a sight element 20. The sight element 20 can include a front surface 20F, a rear surface 20R a first side surface 21S and a second side surface 22L. The front 20F can generally face toward the muzzle 7 of the firearm 5 to which the sight 10 can be joined. The sight element can define a sight window 20W that extends through the sight element, from the front surface 20F to the rear surface 20R, generally between the first side surface 21S second side surface 22S. Within the sight window 20W, a sight post 20P can be located. This sight post 20P can be configured so that upon rotation of the sight disk 20D to which the post 20 is attached, the sight post extends farther upward or downward, to alter a point of aim of the sight 10. In comparing FIGS. 2 and 7, the sight element 20 is selectively configurable in an upright position, shown in FIG. 2, and a down position, shown in FIG. 7. In converting to and from, upright and down positions, the sight element 20 pivots about the longitudinal axis LA.

The sight element 20 can be joined with a base 30. The base 30 can include a mounting portion 32 that is mountable on or to a firearm. This mounting portion, can be structured in a variety of different configurations. As shown, the mounting portion 32 is configured to be mounted on a firearm rail, for example, a picatinny rail which is common to many modern sporting rifles and accessories. The mounting portion 33 can include a front 30F, a rear 30R a first lateral side 31L and a second lateral side 32L, across from one another, and generally on the same respective sides as the first side surface 21S and the second side surface 22S. The sight element 20 also can include a bottom 30B. The bottom 30B can be flanked on opposing sides by first and second bottom walls 30B1 and 30B2. Each bottom wall can include a notch, optionally of a V-shape, configured to fit the rail. The second bottom wall 30B2 can include a block 33, which also includes a notch to accommodate a portion of the rail. The block 33 can be joined with the remainder of the mounting portion 32 via fastener 34. The fastener 34 can be threaded into a corresponding hole in the mounting portion 32 so that the block 33 can be clamped against a rail disposed between the first bottom wall 30B1 and the second bottom wall 30B2. In this manner, the sight can be clamped to the rail. Of course, other configurations of the fastener, block and generally the mounting portion 32 can be utilized in conjunction with the current embodiment of the sight 10.

Figure 3:
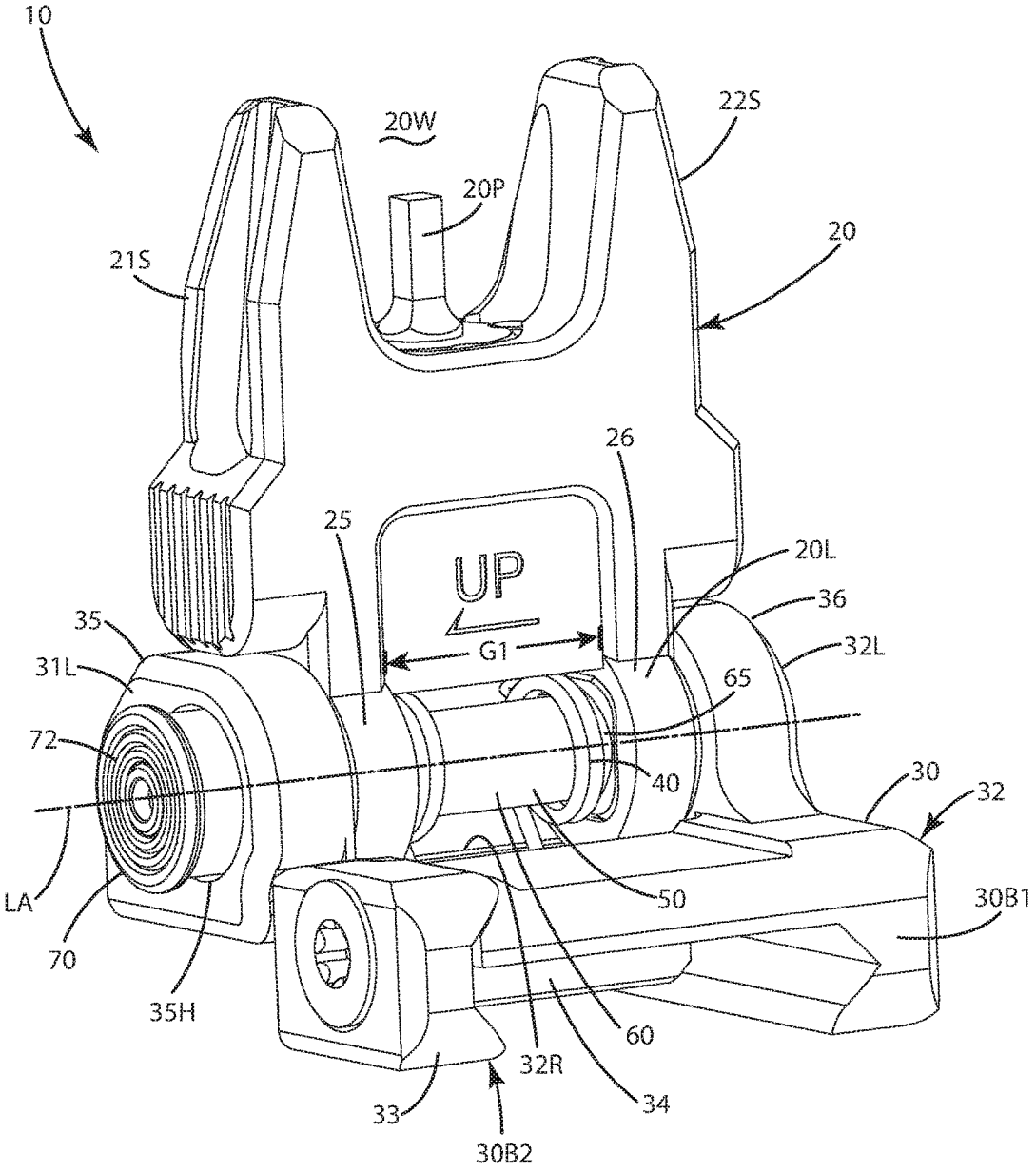
FIG. 3 is a rear perspective view of the sight in the upright position.

The base 30 and the mounting portion 32 can include spaced apart upright first flange 35 and second flange 36. These flanges can correspond to the respective first and second lateral sides of the mounting portion 32 and can extend upward along the same. These upright first and second flanges can extend upward in a substantially vertical manner from the mounting portion 32. These upright flanges also can be spaced from one another such that the sight element 20, and in particular its lower portion 20L can fit between the upright flanges 35 and 36 as shown in FIG. 3. There, the sight element 20 includes a first lower flange 25 and an opposing second lower flange 26. The first lower flange 25 is adjacent the upright flange 35, while the second lower flange 26 is adjacent the second upright flange 36 of the base 30. The two lower flanges 25 and 26 can be separated by a gap G1, which can accommodate a bias element 40 as described in further detail below. Optionally, the mounting portion 32 can include a bias element recess 32R within which a portion of the bias element 40 can be disposed as described in further detail below.

The first and second upright flanges 35 and 36 can define respective holes. For example, the first flange 35 can be can define a first plunger hole 35H, while the second upright flange 36 can define a second plunger hole 36H. The first plunger hole 35H can be of a different geometric shape than the second hole plunger hole 36H. As shown in FIG. 3, the first plunger hole 35 can be of a generally round or circular shape. In contrast, the second plunger hole 36H can be polygonal, for example rectangular.

The first plunger hole can be sized sufficiently to accommodate a portion of a plunger 50, for example, a button 70 joined with or otherwise included in the plunger 50. The button can fit slidably within the first plunger hole 35H. The button 70 also can include a hollow core or compartment 71 under the exterior surface 72. Within this compartment 71, a secondary bias element, such as a coil spring 73, can be disposed. This secondary spring 73 can be referred to as a plunger spring, and can urge the button 70 away from the first upright flange 35. The secondary bias element 73 can be compressed between a portion of the button 70 and the upright flange 35. Optionally, the portion of the upright flange 35 adjacent the button 70 can define a recess around the hole 35H. This recess optionally does not extend all the way through the upright flange, but with the compartment 71 forms a chamber within which the bias element 73 is disposed.

Figure 4:
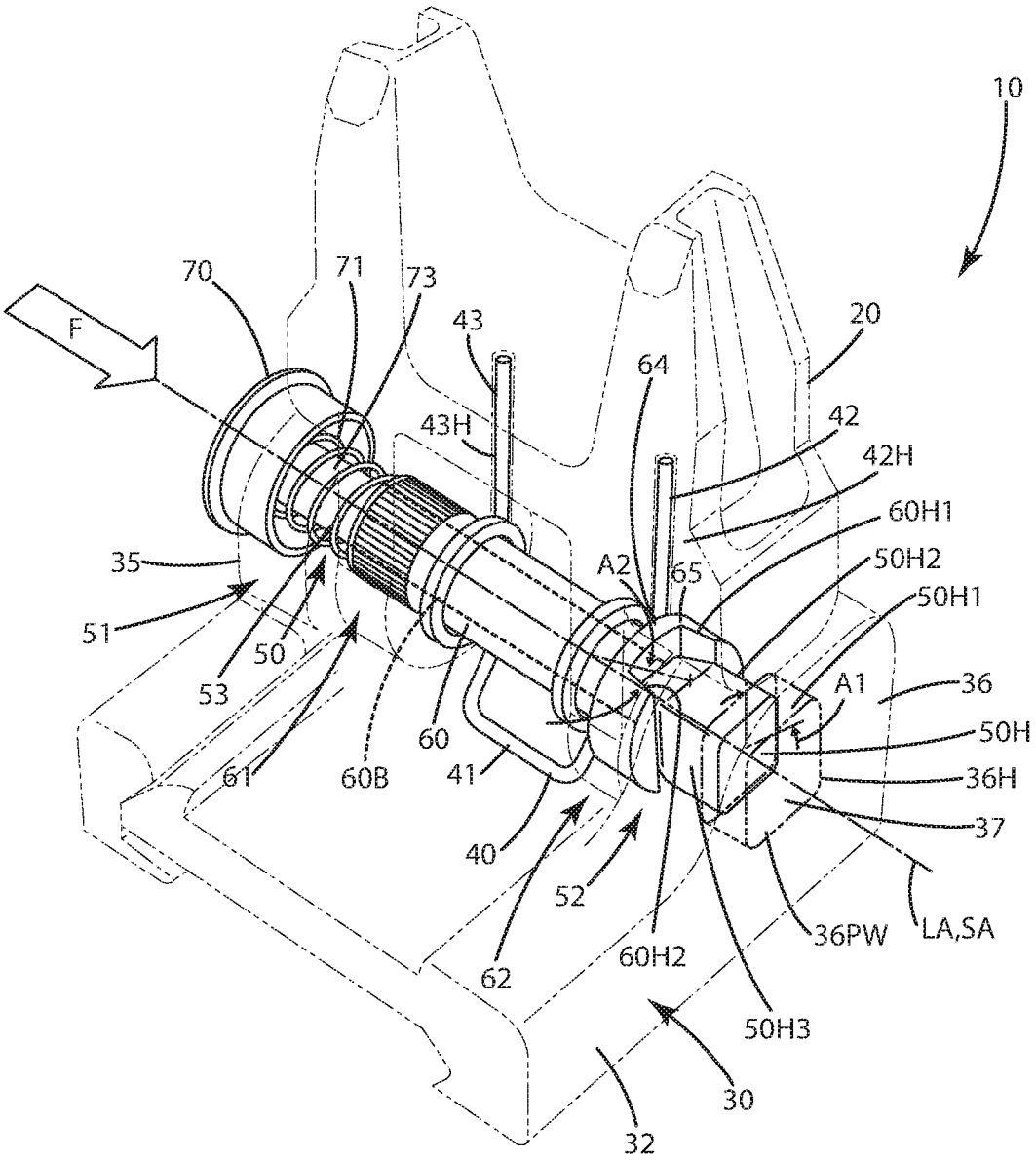
FIG. 4 is a rear partial section view of the sight locked in the upright position with a force being manually applied to move a plunger of the sight and unlock the sight.

The second upright flange 36 can define the second plunger hole 36H to accommodate a portion of the plunger 50. As illustrated the plunger hole 36H can be bounded by a second plunger hole perimeter wall 36PW. This perimeter wall 36PW can be of a similar and/or identical shape as a head 50H of the plunger 50, which is described in further detail below. As shown, the perimeter wall 36PW and the plunger hole 36H in general can be of a polygonal shape. A head 50H of a similar polygonal shape thus will not rotate within the hole 36H. In this manner, the plunger 50 can be non-rotatable and only linearly movable relative to the base 30, and in particular the mounting portion 32 and/or the respective flanges 36 and 35. Optionally, the second plunger hole 36H can be bounded by insert 37. This insert can include the perimeter wall 36PW that engages the head 50H directly. The insert 37 can be constructed from a harder, more durable and abrasion resistant material than the base 30 and/or the sight element 20. For example, the base 30 and the sight element 20 can be constructed from aluminum, while the insert 37 can be constructed from steel. The head 50H and the remainder of the plunger 50, as well as an optional sleeve 60, also can be constructed from steel or some other harder, abrasion resistant and durable material. This is so that upon repeated use, movement of the plunger relative to other parts of the sight, for example the insert 37, do not wear out those parts, thus causing slop or in unacceptable tolerances between the parts, which might affect their performance, alignment and/or zero. As shown in FIG. 4, the plunger hole 36H and the optional insert 37 can extend completely through the second upright flange 36. Of course, in some applications, the hole and insert may extend only partially through the second upright flange 36. As illustrated, the head 36H is reciprocally disposed in the hole 36H during operation of the plunger 50. Further, in all modes of the plunger, the head 50H and its surfaces can be engaged with or otherwise contacting the perimeter wall 36PW or portions or surfaces thereof or of the hole 36H to some extent. Generally, the plunger head 50H can be slidably disposed within at least a portion of the hole 36H as the sight element 20 is moved or otherwise rotated from the upright position to the down position and vice versa as described below.

With reference to FIG. 4, the sight 10 can include a bias element 40. The bias element 40 can be wound to store a spring force that generally urges the sight element 20 to the upright position shown in FIG. 4. The bias element 40 can be in the form of a partial coil spring that extends around the plunger 50 and/or the sleeve 60. The bias element 40 can be disposed between the lower flanges 25 and 26, generally within the gap G1 between those flanges. The coil spring can be exposed to the environment and visible to a user. The coil spring 40 also can include a first spring portion 41 that engages the mounting portion 32 and/or base 30. This first spring portion 41 can extend to a portion of a coil the coils around the sleeve 60 and/or the plunger 50. The spring also can include one or more second spring portions 42, 43 that project into a corresponding spring holes 42H, 43H defined by the sight element 20. These second spring portions optionally can be linear extensions of the spring coming off the coil portion of the spring.

As configured, this bias element 40 can urge the sight element 20 to the upright position shown in FIG. 4. Further, when the plunger 50 is in a free mode such as that shown in FIG. 6, the bias element 40 can exert a force between the base 30 and the sight element 20 so as to urge the sight element, and thus automatically deploy the sight element without further manual input by the user from the down position to the upright position.

As mentioned above, the sight element includes a plunger 50. The plunger 50 can be movable linearly along the longitudinal axis LA. This longitudinal axis LA can coincide with a longitudinal axis of the plunger itself 50, an axis of the sleeve 60 and/or generally an axis of a bore 65 that is defined by the sight element 20, for example, through the lower flanges 25 and 26. The plunger 50 can be reciprocally slidable in the bore 65 and/or relative to the sleeve 60 where included, generally along the longitudinal axis LA.

The plunger 50 can include a first end 57 and a second end 52. The first end can be manually engageable by a user. For example, a user can engage the button 70 joined with the first end 51 of the plunger 50. Optionally, the end 51 can include threads, and the button 70 can include corresponding threads to attach the button 70 to the plunger 50. In other applications, these two components can be integral with one another. The first end 51 also can extend through the first upright flange 35 of the base 30.

The plunger can include a shaft 53 that extends from the first end 51 to the second and 52. The shaft can be of a cylindrical shape as shown. In some cases, the shaft effectively acts as an axle about which the sight element 20 rotates. The shaft can be sized to fit with minimal tolerance within the bore 65 or within a bore 60B of the sleeve 60. The shaft 53 can include a shaft axis S which coincides with the longitudinal axis LA. Likewise, the bore and sleeve can each include an axis that coincides with the longitudinal axis.

With reference to FIGS. 4-7, the second end 52 of the plunger can include a head 50H. This head 50H can be of a polygonal cross section, and optionally can be outwardly tapered, away from the longitudinal axis LA, as it extends toward the second end 52. The head 50H can include a first head locking surface 50H1 and a second head locking surface 50H2. The first head locking surface and the second head locking surface can be offset from one another by angle A1, which optionally can be 90°. Of course, this angle A1 can be 45°, 60°, 90°, 120°, 180°, 270° or other angles depending on the orientation of the head 50H and corresponding orientation of the sight element 20.

As shown, the outer most portion of or distal portion the head 50H can be rectangular, with rounded corners. The shape can correspond to the plunger hole 36H shape so the head does not rotate relative to the upright flange or within the plunger hole. The first head locking surface 50H1 and the second head locking surface 50H2 optionally can be substantially parallel to the longitudinal axis LA. As shown in FIG. 4, however, the first head locking surface 50H1 and second head locking surface 50H2 can be offset at an angle A2 relative to the longitudinal axis LA, when extending toward the distal portion of the head 50H. This angle A2 can be an acute angle as illustrated, for example, optionally 15° to 45°, further optionally 20° to 35°, or other angles depending on the particular application and interaction or engagement of the head with the sleeve. The head 50H can include third 50H3 and fourth 50H4 head locking surfaces disposed across the axis LA from the first head locking surface and the second head locking surface respectively. These other surfaces can be offset relative to longitudinal axis by angles similar to angle A2 noted above.

The sight element 20, as mentioned above, can define a bore 65. The pore optionally can be aligned with or otherwise include a sleeve 60 disposed therein. The sleeve 60 can include an internal bore 60B within which the shaft 53 and plunger 50 can be disposed. The sleeve can include a first end 61 and a second end 62. The first end 61 can be disposed adjacent the first end 51 of the plunger, near the plunger button 70, and the upright flange 35. The second end 62 can be located adjacent the second end 52 of the shaft or plunger 50. The second end 62 can be housed substantially in the sight element 20, for example in the lower flange 26. Optionally, this second end 52 of the sleeve does not protrude beyond the sight element 20, and is not disposed in the second upright flange 36. The sleeve can be configured to rotate around the shaft 53 when the plunger 50 is in a free mode, as described below.

The sleeve can include a sleeve crown 64, also referred to as a slotted crown 64, at the second end 62 of the sleeve 60. This slotted crown, and the sleeve generally, can include a first sleeve locking surface 60H1, as well as a second sleeve locking surface 60H2. These surfaces 60H1 and 60H2 can be disposed on opposite sides of a slot 65 defined by the crown 64 and the sleeve 60. The slot 65 can be can extend generally perpendicular to the longitudinal axis LA. The slot 65 can be adjacent the second end 62 of the plunger 50 and/or the sleeve 60. The sleeve locking surfaces also can be disposed on opposite sides of longitudinal axis LA when the sight element 20 is in the upright position.

The first sleeve locking surface 60H1 can bound a first portion of a lock slot 65, while the second sleeve locking surface 60H2 can bound an opposing second portion of the lock slot 65.

As described in further detail below, the lock slot and tubular sleeve, along with the crown and the remainder of the sight element and its features, rotate about 90° relative to the head 50H of the plunger 50 when the sight element 20 is rotated from the upright position shown in FIG. 4 to the down position shown in FIG. 7. Generally, the first and second sleeve locking surfaces are substantially vertical when the sight element is in the upright position, however, when the sight element is in the down position, the first and second sleeve locking surfaces are substantially horizontal. Generally speaking, the first and second sleeve locking surfaces rotate about the longitudinal axis LA with the sight element as described in below.

As mentioned above, the sleeve 50 and the crown 64 can be stationary relative to the sight element 20, but rotatable relative to the plunger and base. This movement and the general operation of the sight 10 will now be described with reference to FIGS. 4-7. The plunger 50 as noted above is reciprocally slidable along longitudinal axis through the sight element and the optional sleeve. As shown in FIG. 4, the sight 10 is in an upright position. The plunger 50 is configured in an upright locking mode. In this upright locking mode, the head 50H is registered in both the plunger hole 36H and the crown 64. The head 50H itself is partially disposed in the crown 64 and locking slot 65. In this configuration, the first head locking surface 50H1 engages the first sleeve locking surface 60H1. These two surfaces can be substantially parallel to one another. These surfaces do not rotate relative to one another when engaged, so they also maintain the sight element 20 locked in and nonrotatable from the in the upright position. The head also at least partially protrudes into the plunger hole 36H. The opposing side of the head 50H3 also can be engaged against the second sleeve locking surface 60H2. In this construction, the two crown surfaces engage the two head surfaces and prevent rotation of the crown, sleeve and sight element relative to the plunger.

The plunger 50 as mentioned above is also configurable in a free mode. In this mode, the head 50 is generally disengaged from the crown 64, and the sleeve 60 and the sight element 20 in general. In this configuration, the head 50H does not restrain rotation of the sleeve and sight element relative to the plunger. Accordingly, the sight element can be rotated by the user about longitudinal axis LA from the upright position to the down position. In so doing, however, where the bias element 40 is present, the user engages and overcomes, the spring force exerted by the bias element on the sight element.

Figure 5:
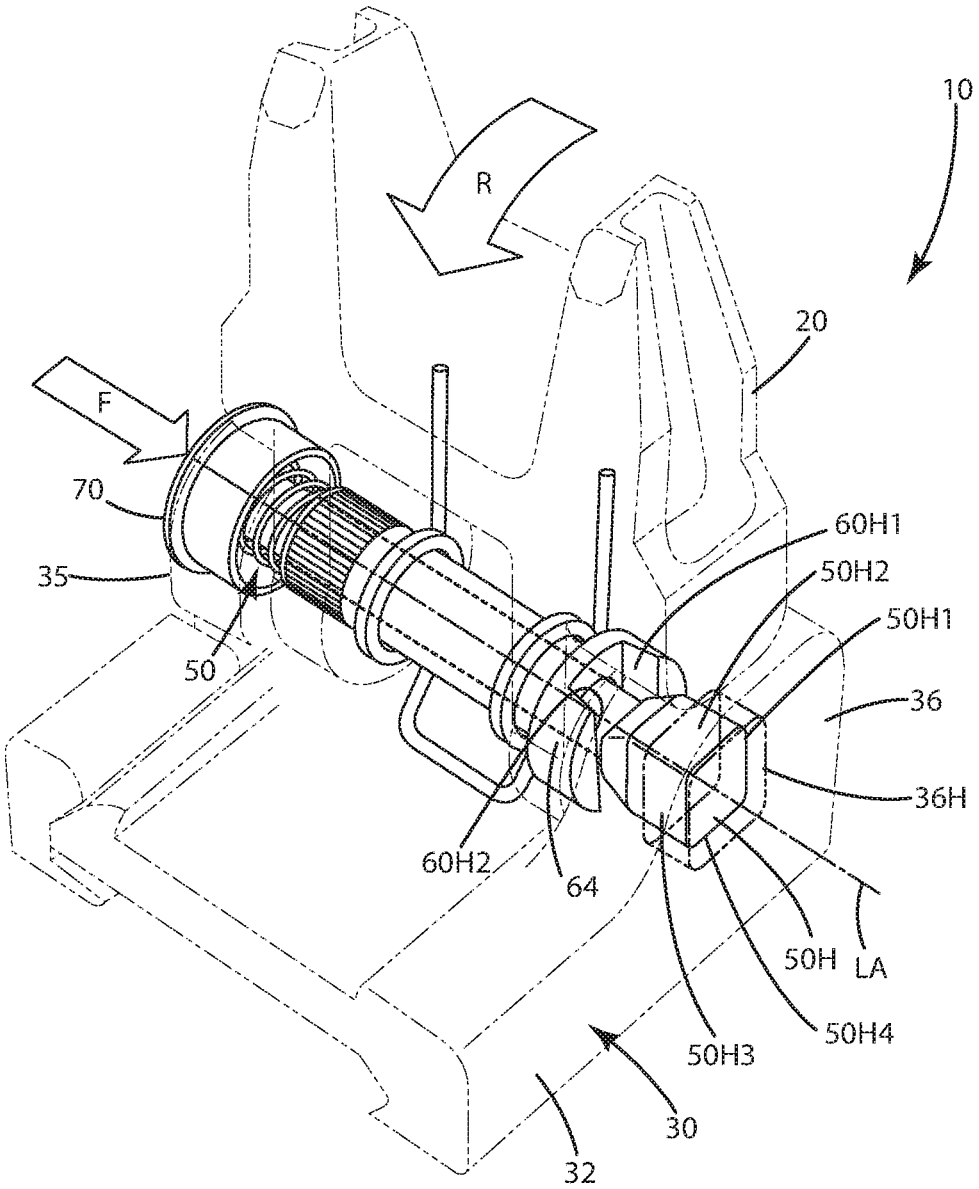
FIG. 5 is a rear partial section view of the sight having been unlocked but still in the upright position with the force still being applied to hold the plunger so as to unlock the sight so it can be rotated to a down position.

With reference to FIGS. 4-5, a user exerts a force F against the plunger 50. The user can do so by pressing manually against the plunger button 70. As a result of this force F being applied to the plunger, the spring 73 compresses and the plunger slides linearly along the longitudinal axis LA toward the upright flange 36. The plunger slides through the bore and sleeve in so doing. The head also slides and moves farther into the second plunger hole 36H defined by the second upright flange 36. The first and third head locking surfaces 50H1 and 50H3 disengage the first and second sleeve locking surfaces 60H1 and 60H2. With these surfaces disengaged by the head, the sight element 20 and the sleeve 60 are rotatable about the longitudinal axis LA, and generally about the shaft 53 of the plunger 50.

Accordingly, as shown in FIG. 5, while the plunger is in the free mode, a user can exert a rotational force R on the sight element 20. This rotational force R can rotate the sight element 20 and sleeve 60 relative to the plunger 50 because the head locking surfaces are disengaged from the sleeve locking surfaces and the crown 64. Thus, the sight element 20 moves downward toward the mounting portion 32 of the base 30.

Figure 6:
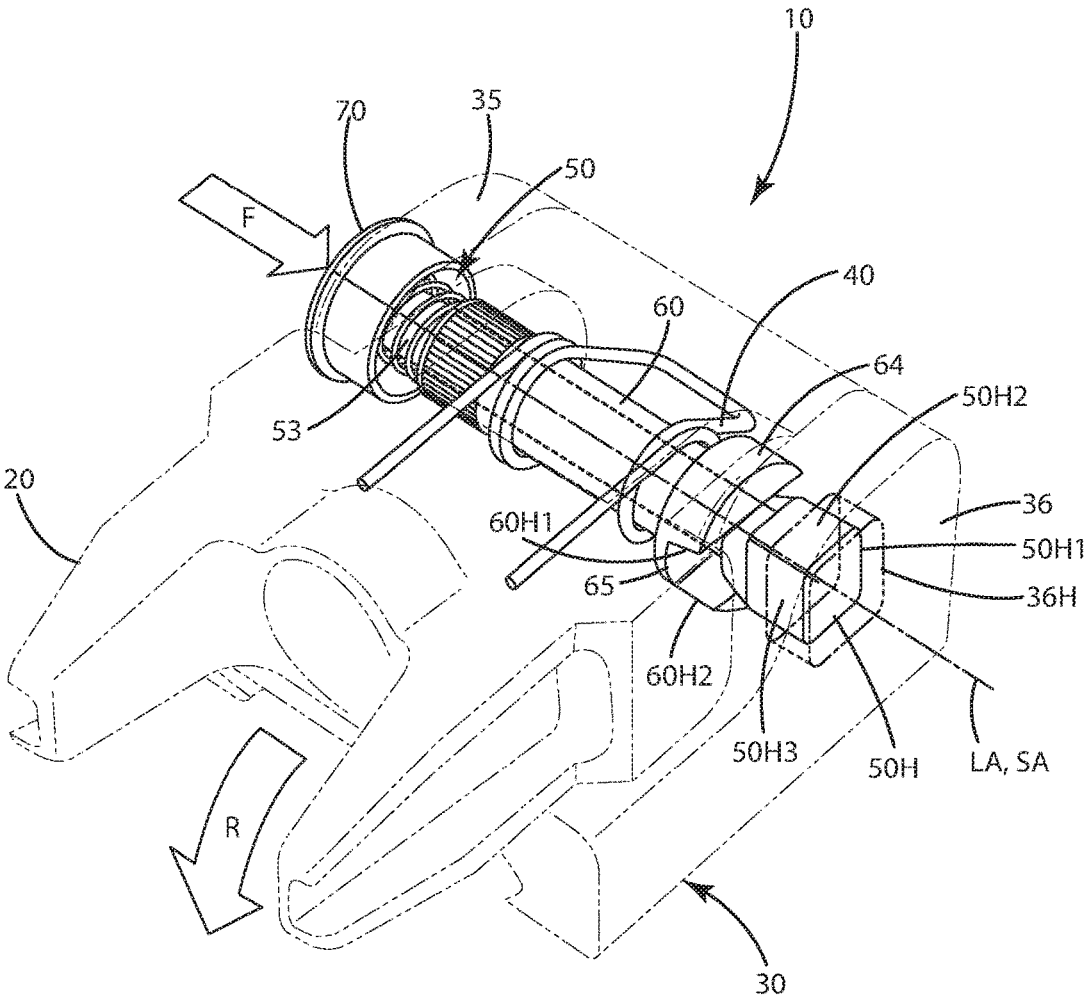
FIG. 6 is a rear partial section view of the sight being moved to the down position with the force being still being applied to hold the plunger in the unlocked position.

The rotational force R can be continued to be applied as shown in FIG. 6. There, the plunger 50 is still in the free mode, with the head 50H still disengaged from the crown 64 and the slot 65. The plunger head 50H still also remains substantially in the plunger hole 36H defined by the second upright flange 36. In this configuration, the crown and sleeve are oriented such that the first and second sleeve locking surfaces 60H1 and 60H2 are reconfigured to a substantially horizontal configuration. Optionally, these surfaces are approximately offset 90° from the position they previously were in when the sight element 20 was in the upright position. During the transition of the sleeve 60 and the sight element 20 while the plunger is in the free mode, the head 50H, however, remains registered in the second plunger hole 36H and generally does not rotate. The plunger shaft 53 can operate as an axle about which the sleeve 60 and the sight element 20 rotate.

As the sight element 20 is pushed or urged to the down position shown in FIG. 6, the rotational force R overcomes the spring force exerted by the bias element 40 on the sight element 20. The spring 40 also stores the energy due to the rotational force R therein so as to be able to automatically rotate the sight element 20 back up to the upright position when the plunger is in the free mode again.

Figure 7:
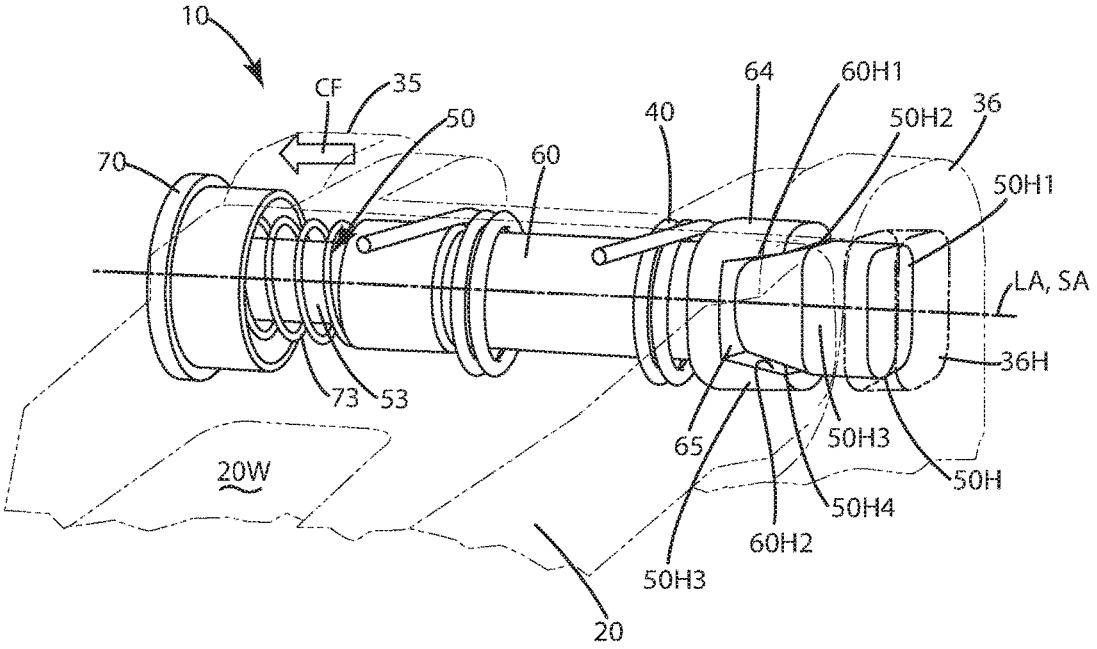
FIG. 7 is a rear partial section view of the sight with the force being removed from the plunger so that the plunger engages a sleeve to lock the sight element in the down position.

As shown in FIG. 7, the plunger is configured in a down locking mode in which the plunger maintains the sight element 20 in the down position. More specifically, upon reaching the down position shown in FIG. 7, a user can remove the previously applied force F. As a result, the spring force CF stored within the spring 73 pushes against the button 70 thus pushing the plunger and head in direction L. As a result, the plunger head 50H registers within the crown slot 65 of the crown 64, but with the crown now reoriented such that the first and second sleeve locking surfaces are generally horizontal. In this position, the sleeve locking surfaces 60H1 and 60H2 are now oriented to engage the head locking surfaces 50H2 and 50H4. When the head 50H enters the slot 65 in the crown 64, these head locking surfaces engage the sleeve locking surfaces and can slide along them. Due to the optional taper of the sleeve locking surfaces 60H1 and 60H2 (which also can be generally acutely angled relative to the longitudinal axis LA) the head locking surfaces can slide into and are captured by the slot in the crown. The head 50H bottoms out against these surfaces and is pulled generally tightly into engagement with the surfaces via the spring force CF exerted by the coil spring 73. As a result, the head and plunger in general attains a down locking mode to lock the sight element 20 in the down position as shown in FIG. 7.

To release the sight element 20 from this down locking mode and down position, the user can exert a force F against the button 70, which will slide the plunger 50 along the longitudinal axis. As a result, the head 50H disengages from the crown and during this disengagement, the bias element 40 will exert a spring force against the sight element 20 to urge it from the down position to the upright position. In this manner, the plunger automatically deploys the spring loaded sight element to the upright position. After the sight element 20 is deployed, the user can release the plunger in the head so it again interlocks with the crown and the bore of the sight element to lock the sight element 20 in the upright position. This can prevent the sight element from collapsing to the down position until the plunger is manually engaged to a free mode again.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A selectively configurable sight for a firearm comprising:

a base including a mounting portion mountable on a firearm rail, the mounting portion including a front side, a rear side, opposing lateral sides, a bottom, and a fastener configured for mounting the base to the firearm rail, the base including spaced apart first and second upright flanges, the first upright flange defining a first plunger hole, the upright second flange defining a second plunger hole bounded by a second plunger hole perimeter wall;

a sight element pivotally mounted to the upright first and second upright flanges of the base, the sight element including a first side surface and an opposing second side surface, a front surface and a rear surface with a sight window defined by the sight element, extending from the front surface to the rear surface, the sight element selectively configurable in an upright position and in a down position;

a bias element engaged with the sight element and the base to urge the sight element to the upright position;

a tubular sleeve extending between the first side surface and the second side surface of the sight element, the tubular sleeve defining a sleeve bore therethrough and including a longitudinal axis, the tubular sleeve including a first sleeve locking surface, the tubular sleeve being generally fixed and non-rotatable relative to the sight element; and a plunger disposed in the sleeve bore, the plunger extending along the longitudinal axis, the plunger including a first end and a second distal end, the second distal end including a head, the head being registered in the second plunger hole such that the head engages the second plunger hole perimeter wall so that the plunger head is non-rotatable relative to the second upright flange, the head including a first head locking surface and a second head locking surface offset from the first head locking surface, wherein the plunger is reciprocally slidable in the sleeve along the longitudinal axis, wherein the plunger is configurable in an upright locking mode in which the first head locking surface engages the first sleeve locking surface to maintain the sight element in the upright position, while the head at least partially protrudes into the second plunger hole, wherein the plunger is configurable in a down locking mode in which the second head locking surface engages the first sleeve locking surface to maintain the sight element in the down position, while the head at least partially protrudes into the second plunger hole, wherein the plunger is configurable in a free mode in which the head is disengaged from the first sleeve locking surface so that the sight element can be rotated from the upright position to the down position.

2. The sight of claim 1 comprising:

a button joined with the first end and manually operable to move the plunger from the down locking mode to the free mode;

a shaft extending from the first end to the second end at which the shaft is joined with the head;

wherein the button is threadably engaged with the shaft at the first end, wherein the bias element is configured to urge the sight element to the upright position when the plunger is in the free mode.

3. The sight of claim 2, wherein the bias element is a coil spring extending around the shaft, wherein the bias element includes a first spring portion that engages the mounting portion and a second spring portion that projects into a spring hole defined by the sight element.

4. The sight of claim 3, comprising:

a plunger spring distal from the coil spring and disposed between the first upright flange and the button, the plunger spring configured to urge the button away from the first upright flange.

5. The sight of claim 1, wherein the tubular sleeve defines a lock slot adjacent the second end of the plunger, wherein the first sleeve locking surface bounds a first portion of the lock slot, wherein the lock slot and tubular sleeve rotate about 90° relative to the head when the sight element rotates from the upright position to the down position.

6. The sight of claim 5, comprising:

a second sleeve locking surface that bounds a second portion of the lock slot across the longitudinal axis from the first sleeve locking surface, wherein the first sleeve locking surface and second sleeve locking surface are substantially vertical when the sight element is in the upright position, wherein the first sleeve locking surface and second sleeve locking surface are substantially horizontal when the sight element is in the down position.

7. The sight of claim 1, wherein the second plunger hole perimeter wall is constructed from steel, wherein the head of the plunger is constructed from steel, wherein the base and the sight element are constructed from aluminum.

8. The sight of claim 7, wherein the sight element rotates about the longitudinal axis when the plunger is depressed linearly along the longitudinal axis.

9. The sight of claim 1, wherein the first head locking surface and the second head locking surface are offset from one another 90° about the longitudinal axis, wherein the first head locking surface and the second head locking surface are each offset at an acute angle relative to the longitudinal axis.

10. A selectively configurable sight for a firearm comprising:

a base including a mounting portion mountable on a firearm rail, the mounting portion including a flange defining a plunger hole;

a sight element pivotally mounted to mounting portion, the sight element including a first side surface and an opposing second side surface, a front surface and a rear surface with a sight window defined by the sight element, extending from the front surface to the rear surface, the sight element selectively configurable in an upright position and a down position;

a bias element configured to engage the sight element and urge the sight element to the upright position;

a bore extending between the first side surface and the second side surface of the sight element, the bore including a longitudinal axis and a first surface; and a plunger reciprocally slidable in the bore along the longitudinal axis, the plunger including a first end manually engagable by a user, and a second distal end, the second distal end including a head registered in the plunger hole such that the plunger head is non-rotatable relative to the flange, the head including a first head locking surface and a second head locking surface offset from the first head locking surface, wherein the plunger is configurable in an upright locking mode in which the first head locking surface engages the first surface to maintain the sight element in the upright position, while the head at least partially protrudes into the plunger hole, wherein the plunger is configurable in a down locking mode in which the second head locking surface engages the first surface to maintain the sight element in the down position, while the head at least partially protrudes into the plunger hole, wherein the plunger is configurable in a free mode in which the head is disengaged from the first surface so that the sight element can be rotated about the longitudinal axis from the upright position to the down position.

11. The sight of claim 10,
wherein the plunger hole is bounded by a steel insert,
wherein the head is constructed from steel,
wherein the head remains in the plunger hole in the upright locking mode, the down locking mode and the free mode.

12. The sight of claim 11,
wherein the plunger includes a shaft,
wherein the shaft has a shaft axis coaxial with the longitudinal axis,
wherein the bore is defined by a sleeve fixedly mounted in the sight element,
wherein the sleeve is configured to rotate around the shaft when the plunger is in the free mode.

13. The sight of claim 10 comprising:
a button joined with the first end and manually operable to move the plunger from the upright locking mode to the free mode;
a shaft extending from the first end to the second end at which the shaft is joined with the head;
wherein the sight element is rotatable about the shaft,
wherein the bias element is a coil spring extending around the sleeve and the shaft,
wherein the coil spring includes a first spring portion that engages the sight element and a second spring portion that engages the base.

14. The sight of claim 10,
wherein the plunger hole is generally rectangular,
wherein the head is generally rectangular so that when the head is in the plunger hole the plunger is impaired from rotating relative to the flange.

15. The sight of claim 10,
wherein the head is a polygonal shape and the hole is the same polygonal shape,
wherein the head interfaces with the hole to prevent rotation of the plunger relative to the base.

16. The sight of claim 10,
wherein the bore is defined by a sleeve fixedly mounted in the sight element,
wherein the sleeve is configured to rotate around the shaft when the plunger is in the free mode,
wherein the sleeve includes a crown defining a slot within which the first surface is disposed, the slot being generally perpendicular to the longitudinal axis, the crown being disposed inside the sight element without extending past the second side.

17. The sight of claim 16,
wherein the first head locking surface is acutely angled relative to the longitudinal axis,
wherein the first surface is acutely angled relative to the longitudinal axis,
wherein the first head locking surface slides relative to the first surface when the plunger is in the free mode.

18. The sight of claim 10,
wherein the plunger includes a button at the first end, opposite the head,
wherein the button is coaxial with the longitudinal axis,
wherein the plunger extends through the sight element first side and second side,
wherein the sight element rotates about the plunger when the plunger is in the free mode,
wherein the bias element is a coil spring extending around the plunger.

19. A method of selectively configuring a sight comprising:
providing a base including a mounting portion defining a plunger hole;
sliding a plunger along a longitudinal axis in a first direction in a plunger bore defined by a sight element in a down position, the plunger including a first end and a second distal end, the second distal end including a head, the head sliding in the plunger bore, so as to configure the plunger in a free mode in which the head disengages the plunger bore so that the sight element is free to rotate about the longitudinal axis from the down position to an upright position;
biasing the sight element from the down position toward the upright position with a bias element; and
releasing the plunger when the sight element attains the upright position so that the plunger slides along the longitudinal axis in a second direction, so the head engages the plunger bore so as to configure the plunger in a locked upright mode so the sight element is locked in the upright position.

20. The method of claim 19,
wherein the bias element is a spring,
wherein the spring automatically rotates the sight element toward the upright position when the sight element is in the free mode.

* * * * *